United States Patent [19]

Lucas

[11] Patent Number: 4,948,190

[45] Date of Patent: Aug. 14, 1990

[54] LOCKING FLAPPER TYPE LATCH FOR CRANE HOOK

[75] Inventor: Charles E. Lucas, Tulsa, Okla.

[73] Assignee: The Crosby Group, Inc., Tulsa, Okla.

[21] Appl. No.: 383,707

[22] Filed: Jul. 24, 1989

[51] Int. Cl.[5] ..... B66C 1/36

[52] U.S. Cl. ..... 294/82.2; 24/599.5

[58] Field of Search ..... 294/82.19–82.21; 24/233–235, 241 P, 241 PP, 241 PS, 241 SB, 241 SP

[56] References Cited

U.S. PATENT DOCUMENTS

| | | | |
|---|---|---|---|
| 926,156 | 6/1909 | Waterhouse et al. | 294/82.2 |
| 1,239,301 | 9/1917 | Pearson | 24/241 PP |
| 2,514,656 | 7/1950 | Manson | 24/241 PP |
| 3,575,458 | 4/1971 | Crook et al. | 294/82.2 |
| 3,831,994 | 8/1974 | Martin | 294/82.21 |
| 4,062,092 | 12/1977 | Tamada et al. | 24/241 SB |
| 4,546,523 | 10/1985 | Bailey | 24/241 PP |

FOREIGN PATENT DOCUMENTS

| | | | |
|---|---|---|---|
| 2520712 | 8/1983 | France | 294/82.2 |

*Primary Examiner*—Johnny D. Cherry
*Attorney, Agent, or Firm*—Head & Johnson

[57] ABSTRACT

A flapper type gate latch for a crane hook includes a hand operated interlocking prevent member which in one mode can be immovably retained closing the mouth of the hook, and in another mode can be immovably retained permitting the free movement of the gate latch from its biased normally closed position to a position wherein the mouth of the hook is open.

5 Claims, 3 Drawing Sheets

LOCKING FLAPPER TYPE LATCH FOR CRANE HOOK

BACKGROUND OF THE INVENTION

Crane type hoist hooks have been provided and taught in the prior art to include gate latches for closing the mouths of such hoist hooks. In some structures dog pins have been used in combination with the latches to hold the gate latches in their closed positions across the mouths of the hooks. U.S. Pat. No. 2,927,358 is one example of a hoist hook having this type of latching mechanism. The concept of a combined hook and latch wherein the latch is pivotally mounted on the hook and normally biased to its closed position and which includes an interlock member that is pivotally mounted on the latch and movable to a first position locking the latch closed, i.e. prevent opening of the latch and to a second open position allowing the latch to be pivoted to an open position, is described in U.S. Pat. No. 3,575,458.

SUMMARY OF THE INVENTION

This invention relates to a combined hook and flapper type gate latch for closing the mouth of the hook and is considered an improvement upon the concepts taught in U.S. Pat. No. 3,575,458 wherein an interlocking prevent member can be locked in a position to prevent opening of the gate latch and/or in a position permitting the free movement of the gate latch from a closed to an open position.

DETAILED DESCRIPTION

Before explaining the present invention in detail, it is to be understood that the invention is not limited to its application to the details of construction and arrangement of parts illustrated in the accompanying drawings, since the invention is capable of other embodiments and of being practiced or carried out in various ways commensurate with the claims herein. Also it is to be understood that the phraseology or terminology employed herein is for the purpose of description and not of limitation.

Figure 1:
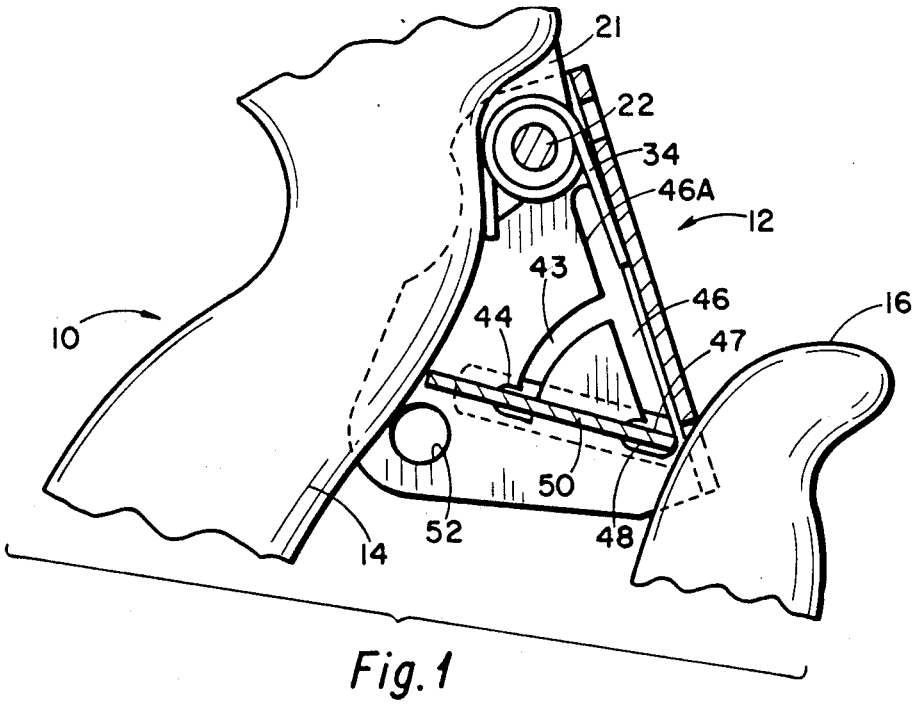
FIG. 1 is a side elevational view showing a hook partially and a latch incorporating the embodiments of this invention in the closed position.
Figure 2:
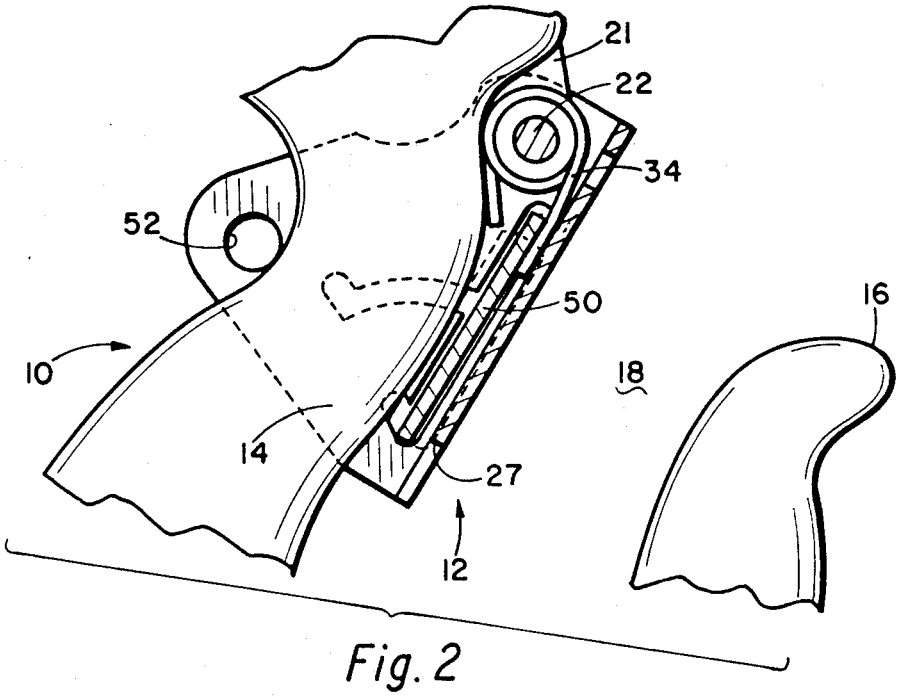
FIG. 2 is a side elevational view showing a portion of a hook and the latch in the open position.

Referring to the drawings, there is shown in FIGS. 1 and 2 a crane hook indicated generally by the numeral 10 in an assembled relationship with the gate latch generally indicated as 12 in the position closing opening 18 between the shank or back portion 14 and an outwardly turned tip or bill 16, with the remaining portion of the generally C-shaped body forming the eye of the hook not being shown. For that description, see for example, U.S. Pat. No. 3,575,458. The end of the hook connecting with the curved shank or back portion 14 may include a ring, a shank, swivel or any other form of connecting mechanism known to those skilled in the art.

Figure 4:
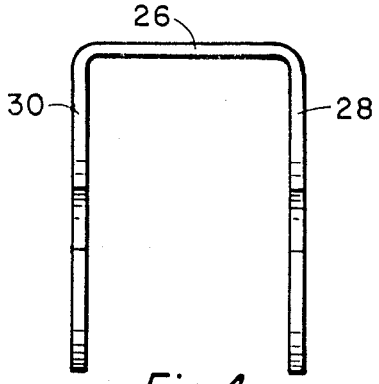
FIG. 4 is a top elevational view taken along the line 4—4 of FIG. 3.
Figure 3:
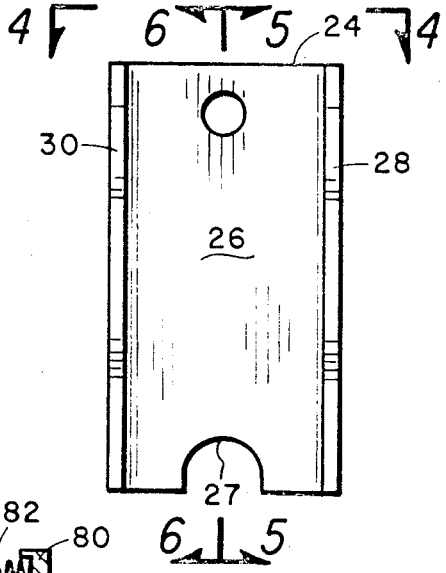
FIG. 3 is a rear elevational view of the latch housing.

The gate latch 12 is located generally across the mouth 18 and pivotally attached to an outwardly directed rib 21 on the inside of the shank 14 utilizing a pivot pin 22. Looking at FIGS. 3 and 4 from the rear or shank side, the latch is comprised of a generally U-shaped member 24 having a flat outwardly facing portion 26 and triangular shaped right side 28 and a left side 30. The base and the sides can be formed from a single flat blank bent into the generally U-shape or cast or fabricated into the U-shape in a manner well known to those skilled in the art.

Figure 5:
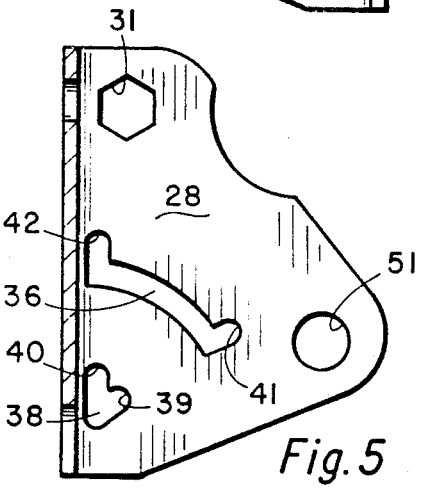
FIG. 5 is a right side sectional view taken along the line 5—5 of FIG. 3.

Looking at the right side view of FIG. 5, opening 31 and, on the left side (FIG. 6), opening 32 are transversely aligned for receiving a pivot member and means 22. Such a pivot member can comprise a nut and a bolt that is projected through a hole in the rib 21 to pivotally mount the latch on the rib. Located between the rib 21 and frontal portion 26 are one or more torsion coil springs 34 which continuously bias the gate latch 12 to a position normally closing the opening 18 wherein slot 27 is against the lip 16. The openings 31 and 32 are adapted to accommodate the bolt head and the nut as part of the pivot mechanism 22. As shown in FIGS. 1 and 2 the pivot member 22 and the torsion spring 34 are located within the body of the U-shaped gate latch, thus protecting these parts from damage and foreign material. As shown in FIG. 5 an arcuate slot 36 is radially located relative to opening 38 which becomes the pivotal center or opening for the interlocking prevent member 50. The pivot opening 38 includes partial radial leg portions 39 and 40 which correspond with respective radial recesses 41 and 42 of the arcuate slot 36.

Figure 6:
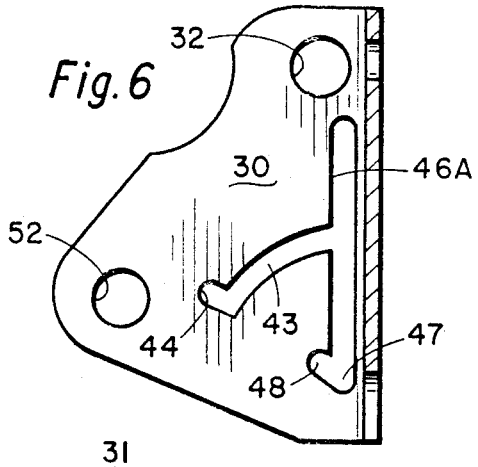
FIG. 6 is a left side sectional view taken along the line 6—6 of FIG. 3.

On the left side, shown in FIG. 6, an arcuate slot 43 and radial recess 44 are transversely aligned with respective right side arcuate slot 36 and radial recess 41. A longitudinal slot 46 is transversely aligned with radial recess 40 and 42 of the right side terminating at its lower end with pivotal opening 47 which includes a radial recess 48 which is transversely aligned with radial recess 39 on the right side. The longitudinal slot is long enough to permit assembly of the prevent member to the sides of the U-shaped body. A pair of transversely aligned openings 51 and 52 are provided in the latch to receive a pin or lock which will permanently retain the latch in the closed position as shown in FIG. 1 or in the open position as shown in FIG. 2.

Figure 9:
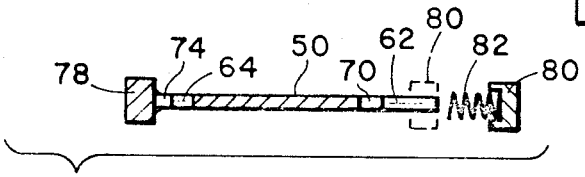
FIG. 9 is a sectional view taken along the line 9—9 of FIG. 7.
Figure 7:
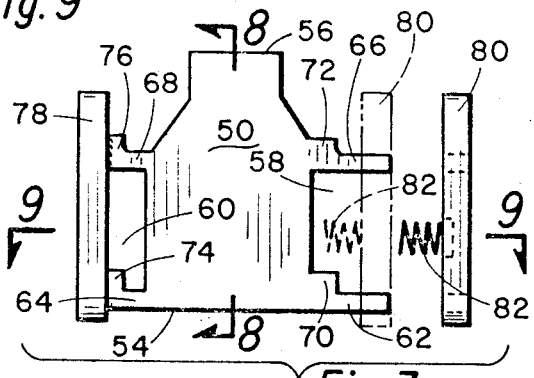
FIG. 7 is a top elevational view of the interlocking prevent member, the right side thereof being shown in exploded view.
Figure 8:
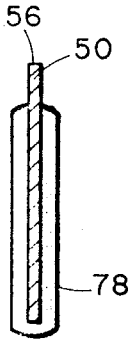
FIG. 8 is a sectional view taken along the line 8—8 of FIG. 7.

Referring now to FIGS. 7, 8 and 9 the interlocking prevent latch is described. The prevent member 50 is formed of a flat plate having a pivot edge 54 and a distal end 56. A U-shaped opening 58 is along the right side while a similar opening 60 is provided on the left side. Opening 58 is formed between a right side pivot leg 62 and and right side guide leg 66. Opening 60 is formed by left side pivot leg 64 and left side guide leg 68. The legs are substantially parallel in the plane of latch 50. The pivot legs on the right side are stepped from a wide portion 70 to a narrow projection 62, to pivot with a similar parallel projection 72 to narrower projection 66 on the guide leg distal side. On the opposite or left side the narrow projection 64 steps to a wider projection 74 and the guide leg steps from 68 to a wider projection 76 on the distal side.

Figure 11:
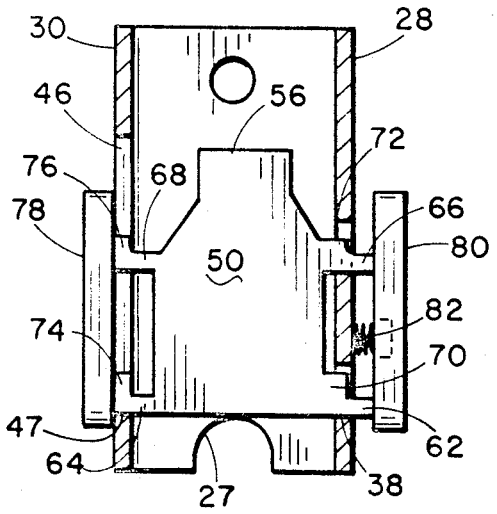
FIG. 11 is a sectional view taken along the line 11—11 of FIG. 10.
Figure 10:
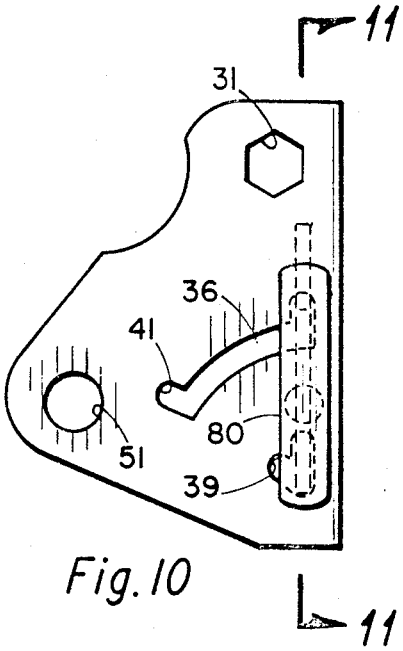
FIG. 10 is a right side elevational view of the assembled latch of this invention in a position wherein the latch may swing from an open to a closed position.

The prevent member 50 is assembled into the U-shaped member by inserting same through longitudinal slot 46 positioning the pivot legs 62 and 64 into the pivot opening 38 and 47 of the respective right and left sides with the distal legs 66 and 68 being positioned within the arcuate slots 36 and 43. Thereafter, a first handle member 78 is welded to the respective projections 74 and 76. A right side handle 80 is preassembled with a spring 82 on the inside portion. The handle is then welded to legs 62 and 66 with the spring 82 being operative against the right outside of the latch side 28 so as to normally bias the prevent latch toward right. This can best be described by reference to FIGS. 10–12 and in particular FIG. 11 which is a view of the latch of this invention from the rear. In the position just described, the respective pivot legs are positioned within pivot openings 38 and 47 such that left side projections 74 and 76, in the position shown in FIGS. 10 and 11, are within the longitudinal slot 46 and thereby incapable of movement downwardly through slot 43 because of the contact of the projection 76 against the edge 46A of longitudinal slot 46. Similarly, projections 70 and 72 on the right side find themselves within the respective radial recesses 42 and 40 of opening 38. Thus the prevent member 50 is incapable of movement to the prevent position of maintaining the latch closed over the opening 18 of the hook (see FIG. 2). In that position the latch 12 is free to move against the bias of spring 34 to normally close the opening 18 yet is capable of being readily opened.

Figure 13:
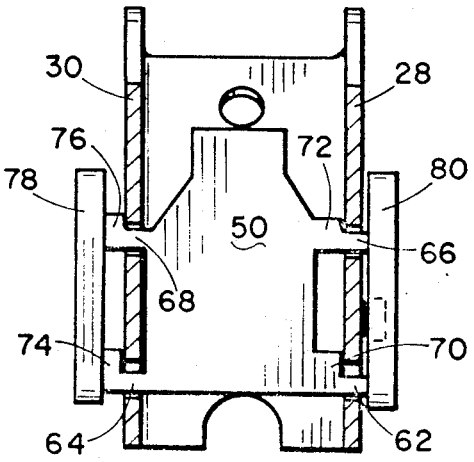
FIG. 13 is a sectional view taken along the line 13—13 of FIG. 12.
Figure 12:
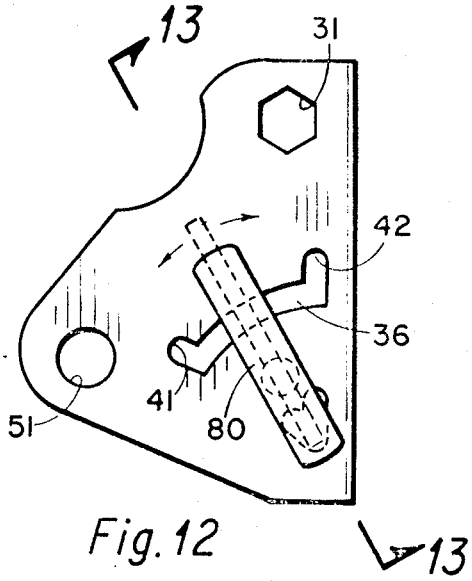
FIG. 12 is a right side elevational view of the assembled latch of this invention depicting the movement of the interlocking prevent member as it is pivoted from its open position to a locked position for preventing the movement of the latch.

Upon grasping of the handles 78 and 80 of the prevent member 50 and moving same to the left against the bias of spring 82 to the position shown in FIGS. 12 and 13, the narrow projections 62 and 66 and 64 and 68 are now operative to enter the arcuate slots 36 and 43 for movement, as shown by the arrows in FIG. 12, to the first non-rotative mode within respective openings 41 and 44 where again, because of the bias of spring 82, the respective projections 70, 72 will enter respective openings 38 and 41 on the right side with projections 74 and 76 entering the longitudinal slot 46 and be locked into place to the position or mode shown in FIG. 1 wherein the latch 12 is incapable of being opened no matter what position the crane hook 10 is in. To return the prevent member 50 to its original position, the process is reversed, that is, the prevent member 50 via handles 78 and 80 is moved to the left against the bias of spring 82 allowing the narrower projections 62, 66, 64 and 68 to enter the respective arcuate slots 36 and 43 until the prevent member has reached the second non-rotative mode being parallel with longitudinal slot 46, or the frontal portion 26.

What is claimed is:

1. In the combination of a hook having a shank and a tip spaced from the shank thereby forming a mouth opening, a U-shaped gate latch body, means pivotally mounting said gate latch body on the hook for selective movement of said gate latch body to a closed position across said mouth opening or to an open position relative to said mouth opening;

a prevent member, said prevent member comprised of a flat plate having a pivot edge and a distal edge, a U-shaped opening along a right side and along a left side of said prevent member defining a pivot leg means as one leg of each said U-shaped opening and a guide leg means forming the distal leg of each said U-shaped opening, said pivot leg means and said guide leg means for each said U-shaped opening comprised of outward substantially parallel stepped right side and left side projections, each of said right side projections being stepped to the right from a wide portion to a narrow portion and each of said left side projections being stepped to the left from a narrow portion to a wide portion;

transversely aligned arcuate slot means in a right side and a left side of said U-shaped gate latch body, each said arcuate slot means having first and second radial recesses at each end of said arcuate slot means, each said arcuate slot means adapted to rotatably receive only said narrow portion of each said right side and left side projections while said first and second radial recesses are adapted to respectively receive said wide portions of said right side and left side projections in a first non-rotative mode of said prevent member when said gate latch body is locked in said closed position or in a second non-rotative mode of said prevent member permitting pivotal movement of said gate latch body from and between said closed position and said open position;

transversely aligned pivot opening means in each said right and left side of said U-shaped gate latch body, each said pivot opening means being radially spaced from each said arcuate slot means, third and fourth radial recesses formed as a part of each said pivot opening means in radial alignment with said respective first and second radial recesses of said arcuate slot means, said pivot opening means adapted to pivotally receive said narrow portions of said right side and said left side projections of said pivot leg means while said third and fourth recesses are adapted to respectively receive said wide portions of said pivot leg means in said first and second non-rotative modes;

spring means to normally bias said prevent member toward the right relative to said U-shaped gate latch body whereby, in said first or second non-rotative mode, said wide portions of said prevent member are retained in their respective said recesses; and means to bias said gate latch body toward said tip.

2. The combination of claim 1 wherein a handle member interconnects with each of said right side and said left side projections.

3. The combination of claim 1 wherein said second radial recess and said fourth radial recess along said left side of said U-shaped gate latch body is a single longitudinal recess of length substantially equal to the length between said pivot edge and said distal edge of said prevent member.

4. A gate latch attachable to a hook for pivotal movement that is normally biased to close a mouth of said hook, said latch comprising:

a U-shaped body defining a right side and a left side extending rearwardly from a front side;

a prevent member, said prevent member comprised of a flat plate having a pivot edge and a distal edge, a U-shaped opening along a right edge and along a left edge of said prevent member, a pivot leg means forming one leg of each said U-shaped opening, and a guide leg means forming the distal end of each said U-shaped opening, said pivot leg means and said guide leg means for each said U-shaped opening comprised of outward substantially parallel stepped projections, each of said projections along said right edge being stepped to the right from a wide portion to a narrow portion and each of said projections along said left edge being stepped to the left from a narrow portion to a wide portion;

transversely aligned arcuate slot means in each said right and left sides of said U-shaped body, first and second radial recesses at each end of said arcuate slot means, said arcuate slot means adapted to rotatably receive only said narrow portions of said right side and said left side projections while said radial recesses are adapted to respectively receive said wide portions of said right side and said left side projections in a first non-rotative mode of said prevent member where said gate latch is locked closing said mouth or in a second non-rotative mode permitting pivotal movement of said gate latch to open and/or close said mouth;

transversely aligned pivot opening means in each said right and left sides of said U-shaped body, each said pivot opening means being radially spaced from each said arcuate slot means, third and fourth radial recesses formed as a part of each said pivot opening means in radial alignment with said respective first and second radial recesses of said arcuate slot means, said pivot opening means adapted to pivotally receive said narrow portions of said right edge and said left edge projections of said pivot leg means while said third and fourth recesses are adapted to respectively receive said wide portions of said pivot leg means in said first and second non-rotative modes;

spring means in said first or second non-rotative mode to normally bias said prevent member toward the right relative to said U-shaped body and thus maintain said wide portions of said prevent member in their respective said recesses; and means to bias said gate latch.

5. A gate latch attachable to a hook for pivotal movement that is normally biased to close a mouth of said hook, said latch comprising:

a U-shaped body defining a right side and a left side extending rearwardly from a front side;

a prevent member having a pivot leg means and a spaced guide leg means, at least one of said pivot leg means and said guide leg means having a narrow portion and a wide portion;

transversely aligned arcuate slot means in each said right and left sides with a radial recess at each end of at least one of said arcuate slot means, said arcuate slot means of a width to receive only said narrow portion and each said recess of a size to receive said narrow portion and said wide portion; and spring means to normally bias said prevent member transversely of said U-shaped body such that when said wide portion is in said radial recess, said prevent member is locked in a non-rotative mode.

* * * * *